US006406347B2

(12) United States Patent
Swagel et al.

(10) Patent No.: US 6,406,347 B2
(45) Date of Patent: Jun. 18, 2002

(54) BUBBLE FORMING MECHANISM

(75) Inventors: Darrin Swagel, St. Louis Park; Steven Huebl, Jordan; Neil Amundsen, Minneapolis; Martijn Loerakker, Eden Prairie; Patrick Sheridan, Minneapolis, all of MN (US)

(73) Assignee: Leisure, Inc., Chanhassen, MN (US)

( * ) Notice: Subject to any disclaimer, the term of this patent is extended or adjusted under 35 U.S.C. 154(b) by 0 days.

(21) Appl. No.: 09/781,536

(22) Filed: Feb. 10, 2001

Related U.S. Application Data

(60) Provisional application No. 60/182,024, filed on Feb. 11, 2000.

(51) Int. Cl.[7] ..... A63H 33/28
(52) U.S. Cl. ..... 446/16; 215/391
(58) Field of Search ..... 446/15, 16, 17, 446/18, 21; 215/390, 391, 228; 220/735, 736, 697

(56) References Cited

U.S. PATENT DOCUMENTS 5,304,085 A * 4/1994 Novak ..... 401/122
5,437,382 A * 8/1995 Gluckman ..... 215/204
5,564,480 A * 10/1996 Chen ..... 141/65
5,586,676 A * 12/1996 Lynd ..... 215/228
6,135,842 A * 10/2000 LaFata ..... 206/207

* cited by examiner

*Primary Examiner*—Jacob K. Ackun
(74) *Attorney, Agent, or Firm*—Boyle Fredrickson Newholm Stein & Gratz S.C.

(57) ABSTRACT

A bubble forming mechanism has a bottle for holding therein a bubble forming solution. The bottle has a concave top surface with a slot formed in the surface. The bottle also includes a guide carried by a portion of the bottle. The mechanism has a wand with a loop carried on a lower end of the wand wherein the wand and loop are capable of being received in the slot and into the bottle. The guide aligns the wand and the loop with the slot.

28 Claims, 8 Drawing Sheets

BUBBLE FORMING MECHANISM

CROSS-REFERENCE TO RELATED APPLICATION

This application claims priority under 35 U.S.C. §119(e) in U.S. Provisional Patent Application No. 60/182,024 that was filed in the United States Patent Office on Feb. 11, 2000, the entirety of which is incorporated by reference herein.

BACKGROUND OF THE INVENTION

1. Field of the Invention

The present invention relates generally to blowing bubbles, and more particularly to a manually operated mechanism capable of efficiently and consistently blowing bubbles.

2. Description of the Related Art

Simple devices and mechanisms are known in the art for blowing bubbles. A typical device includes a container usually formed of plastic and having a screw on cap. A soapy solution is held within the container that is used for blowing bubbles. The container usually comes with a wand that has a loop on one end. A user of the mechanism dips the wand in the solution of the bottle and then removes the wand from the bottle with a thin film suspended in the loop. The user then lightly blows air through the loop to releasing the suspended film of soapy solution to form one or more bubbles.

Other devices are known in the art that automatically create bubbles and are much more complex. These devices continually create bubbles in relatively large quantities. These types of bubble machines are relatively expensive, not particularly portable, and not suitable for occasional use by children and other non-commercial users.

The simple mechanism described above also has a number of problems associated with its use. First, a user must remove the cap from the bottle in order to use the mechanism. If a user drops or tips the bottle when in use, much or all of the solution is spilled and lost through the open top. The wand of this type of mechanism is simple in construction and includes a smooth surfaced and thin elongate portion and a thin loop attached to one end of the elongate portion. A user simply grasps the free end of the wand and manually dips the wand in the solution. The wand is separate from the bottle so a user will usually hold the wand in one hand and the bottle in the other. When blowing bubbles, excess solution dripping from the wand and loop is lost and not returned to the bottle. The wand can also be easily lost.

The cross sectional area of the wand and the loop portion is also typically relatively small. This type of wand cannot pick up a lot of the bubble foaming solution, both because the surfaces are smooth and because the surface area of the material is small. An additional problem with this type of mechanism is that the wand and loop are manually inserted into the opening of the bottle the user is holding the free end of the wand. Insertion of the wand into the bottle is random and can vary from one dip to the next. If the wand and loop are placed in the bottle at an angle it often happens that no soapy solution film is carried out by the loop because the angle forces solution through the loop as it is withdrawn from the bottle removing any film carried by the loop. The user must also aim the loop into the opening for each successive dip. This inhibits rapid, consistent and repeated dips.

SUMMARY OF THE INVENTION

What is needed is a bubble forming mechanism that is essentially as simple in construction and easy to use as the conventional bottle and wand construction. What is also needed is a bubble forming mechanism that is inexpensive to manufacture and assemble and is also very easy to transport by a user similar to the conventional bottle and wand construction. What is further needed is a bubble forming mechanism that can be easily used by children of young ages and yet consistently produce bubbles for their enjoyment. What is additionally needed is a bubble forming mechanism that consistently and efficiently produces bubbles and is capable of producing more bubbles at a faster rate than currently available manual and simple mechanisms. What is also needed is a bubble forming mechanism that will retain more of the soapy solution in the bottle or container and will also prevent or inhibit the solution from spilling if the container is dropped during use. What is additionally needed is a bubble forming mechanism that will retain the wand and loop positioned over the bottle. This returns solution dripping from the wand and loop into the bottle and prevents the wand from being lost.

Meeting these objects, features and advantages, a bubble forming mechanism is provided according to the present invention that includes a bottle for holding a bubble forming solution therein. A wand is provided that can be dipped into the bottle wherein the wand has a bubble-forming loop at one end. A slide is connected to the opposite end of the wand that is received through a guide carried on a portion of the bottle. A slot is provided in a top portion surface of the bottle and the wand and loop are received when solution is retrieved for forming bubbles.

These and other objects, features and advantages of the present invention will become apparent upon reviewing the detailed description and the accompanying drawing figures. The embodiments described herein are presented to illustrate the present invention and not to limit the present invention in any way.

BRIEF DESCRIPTION OF THE DRAWINGS

The following drawing figures illustrate a number of embodiments of the present invention. Like reference numerals provided in the drawings represent like components between embodiments of the invention and, wherein.

DETAILED DESCRIPTION OF THE PREFERRED EMBODIMENTS

Figure 1:
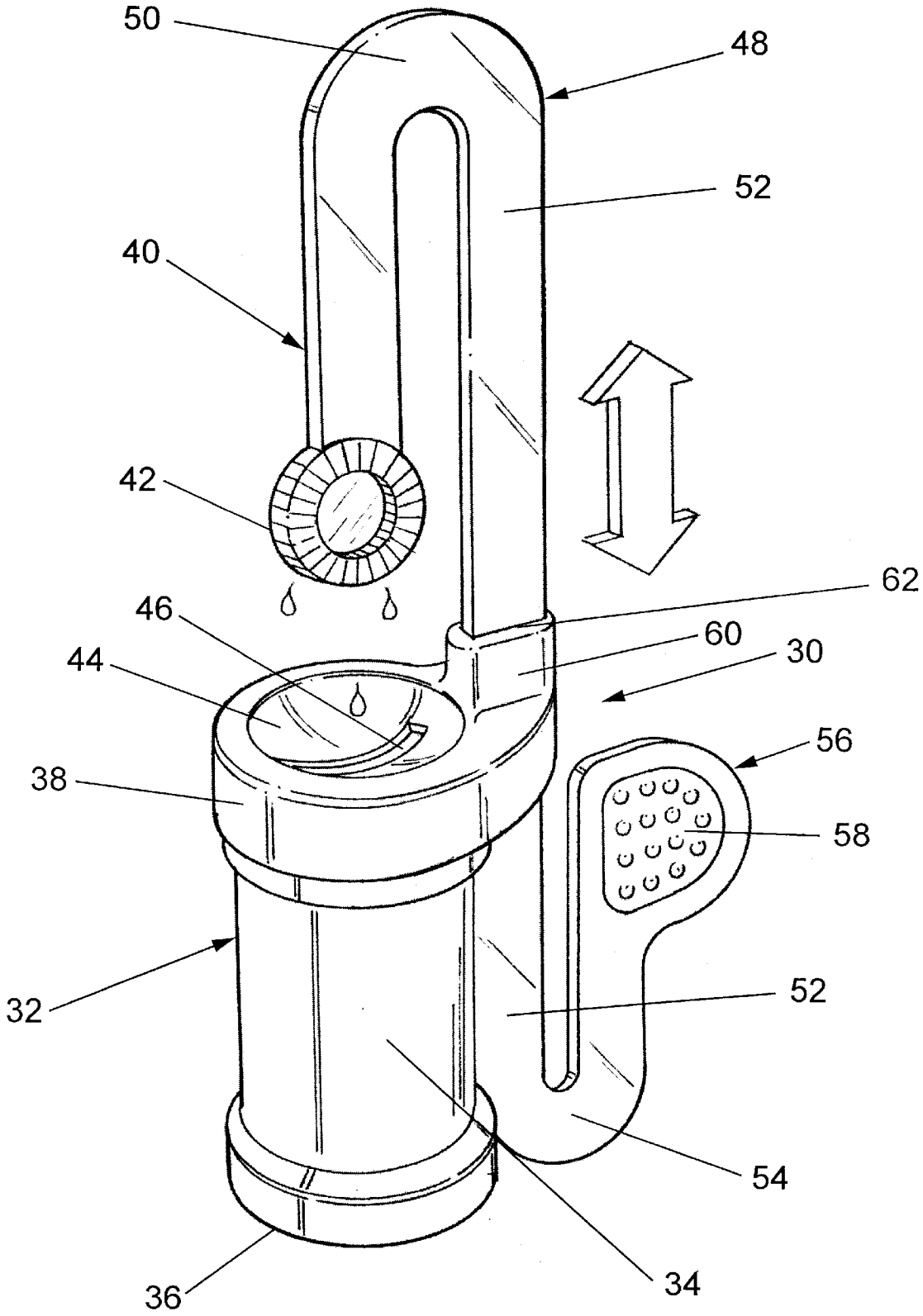
FIG. 1 illustrates a perspective view of a bubble forming mechanism constructed in accordance with one embodiment of the present invention.

Referring to the drawings, FIG. 1 illustrates a bubble forming mechanism 30. According to the present invention, the bubble forming mechanism 30 includes a bottle or container 32 that is shaped to receive and contain a quantity of a bubble forming solution. The container 32 has a perimeter upstanding wall 34 and an enclosed bottom 36. The bottle or container 32 has an open top into which solution can be added to the container 32. The mechanism 30 also includes a container cap 38 that encloses a large majority of the open top of the container 32. The bottle 32 and container cap 38 could be provided as a single uniform structure instead of two separable parts.

The mechanism of FIG. 1 also includes a wand 40 having a loop 42 attached to the lower end of the wand 40. In this embodiment, the loop 42 is integrally formed with the material of the wand 40. The cap 38 or top of the container has a concave top surface forming a bowl or depression 44 in the cap. A receptor slot 46 is formed in the depression or concave surface 44 for receiving the loop 42 and the wand 40 therethrough. The slot 46 is specifically contoured and sized to correspond in length and width to the shape of the loop 42.

Attached to the top end of the wand 40 is a slide 48 for manually lowering and raising the wand 40 and loop 42 into and out of the container 32. For the mechanism 30 of FIG. 1, the slide 48 and the wand 40 are integrally connected by a curved section 50 so that movement of the slide 48 results in corresponding movement of the wand 40. The slide 48 includes an elongate body 52 that extends downward and adjacent to the exterior of the container 32. The lower end of the slide 48 includes another curved portion 54 that transitions into an upward extending handle or grip 56. The handle 56 provides an easy surface for a user to grasp and operate the slide 48. In the embodiment of FIG. 1, the handle 56 includes a surface relief 58 on one portion to assist in gripping the handle 56 and manipulating the slide 48.

The mechanism of FIG. 1 also includes a guide 60 that receives the slide 48 therethrough. The guide 60 supports and holds the slide 48 and hence the wand 40 relative to the container 32. The guide 60 provides a through-opening 62 that closely corresponds to the shape and contour of the slide 48 so that the guide 60 accurately positions the slide 48, and hence, the wand 40 relative to the container 32 even as the slide 48 is moved upward and downward through the guide 60. This also prevents the wand 40 from being separated from the bottle 32.

Figure 2:
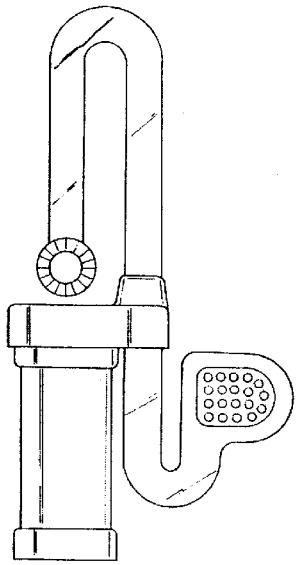
FIG. 2 illustrates a side view of the bubble forming mechanism of FIG. 1 with the wand withdrawn from the container.
Figure 3:
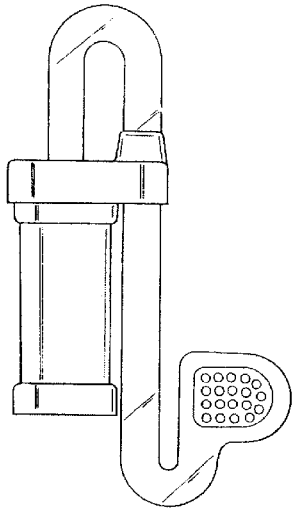
FIG. 3 illustrates a side view of the mechanism of FIG. 1 with the wand inserted into the container.
Figure 4:
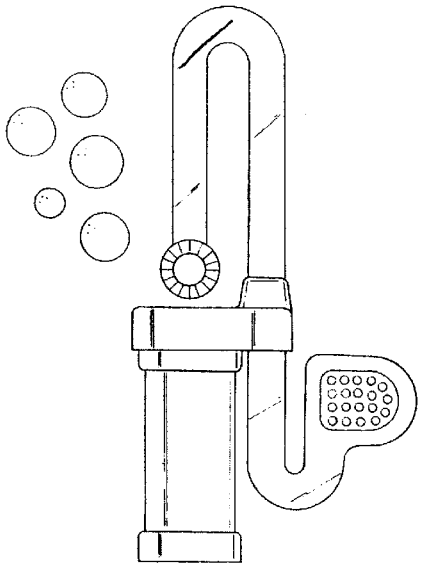
FIG. 4 illustrates a side view of the mechanism of FIG. 1 with the wand again withdrawn from the container after retrieving bubble forming solution and forming bubbles.

In the present embodiment, the guide 60 is carried as an integral portion on the cap 38 and extends outward beyond the exterior surface or perimeter wall 34 of the container 32. A user of the mechanism 30 of FIG. 1 can grip the surface relief 58 of the handle 56 and move the slide 48 in the direction of the arrows upward and downward relative to the container 32. FIG. 2 illustrates the slide 48 and wand 40 in an upward position wherein the wand 40 and loop 42 are withdrawn from the container 32. FIG. 3 illustrates the slide 48 in a lowered condition wherein the wand 40 and loop 42 are received in the container 32. When the container 32 is filled with a bubble forming solution, an individual then moves the slide 48 from the withdrawn position of FIG. 2 to the inserted position of FIG. 3 and then withdraws the wand 40 and loop 42 from the container 32 by moving the slide 48 back to the withdrawn position. By doing so, the loop 42 picks up a film of bubble forming solution. The user can blow through the loop 42 and form bubbles.

The slide 48 and guide 60 permit repetitive, accurate and consistent placement of the wand 40 and loop 42 in the container 32 to the same depth and at the same angle each time the mechanism 30 is used. Additionally, the handle 56 and slide 48 permit an individual to very quickly and repeatedly dip the loop 42 into the solution for forming a large quantity of bubbles at a very fast rate. The slide 48 and guide 60 also position the wand 40 and loop 42 directly over the slot 46 so that excess solution dripping from the wand 40 and loop 42 returns to the slot 46. The curved top surface 44 also assists in directing the solution back to the slot 46.

Figure 5:
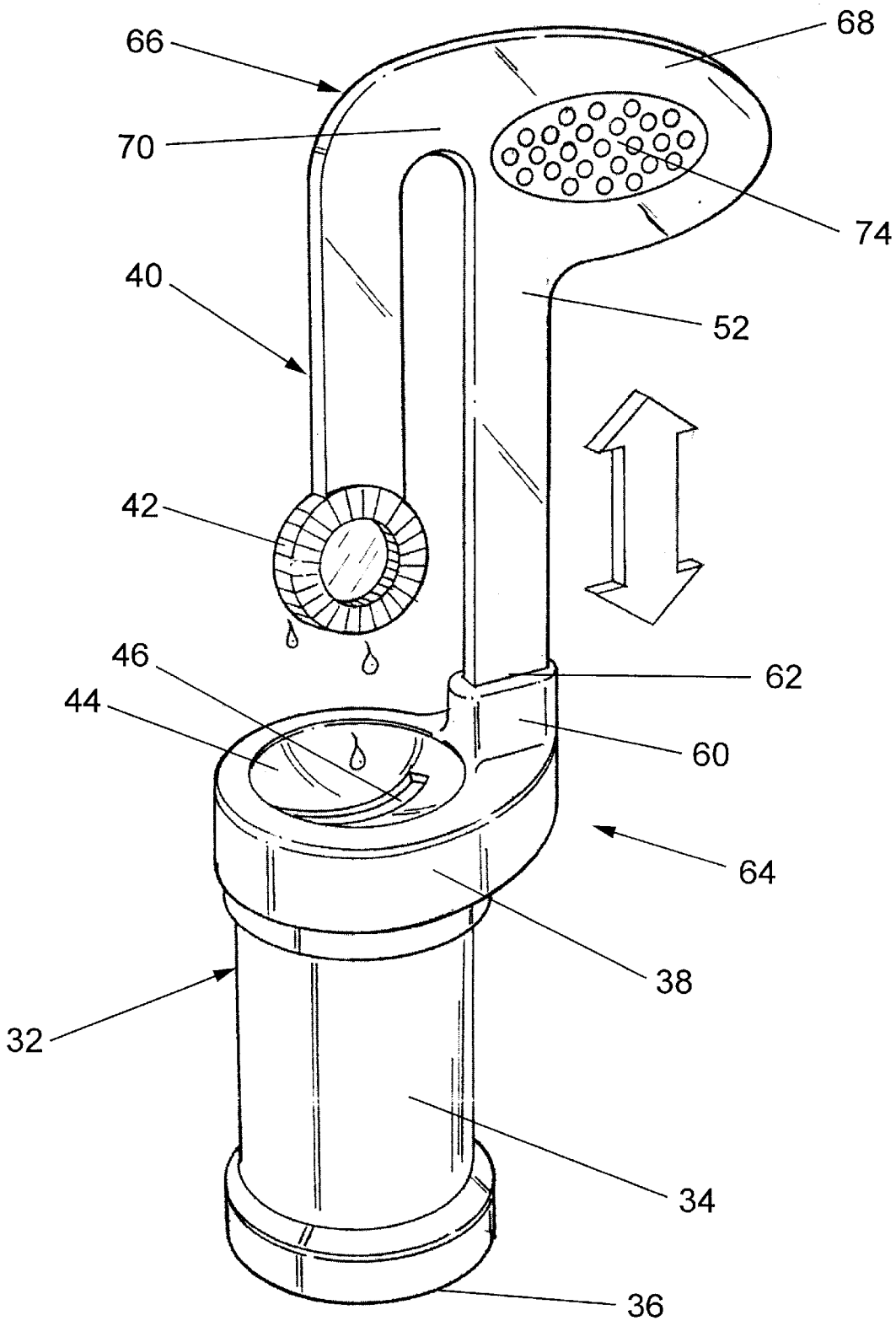
FIG. 5 illustrates a perspective view of a bubble forming mechanism constructed in accordance with another embodiment of the present invention.

Referring to FIG. 5, an alternative embodiment of a bubble forming mechanism 64 is shown. The mechanism 64 includes a container 32, cap 38, wand 40 and loop 42 that are essentially identical to those disclosed in FIG. 1. The guide 60 is also essentially identical and receives a slide 66 therethrough.

Figure 6:
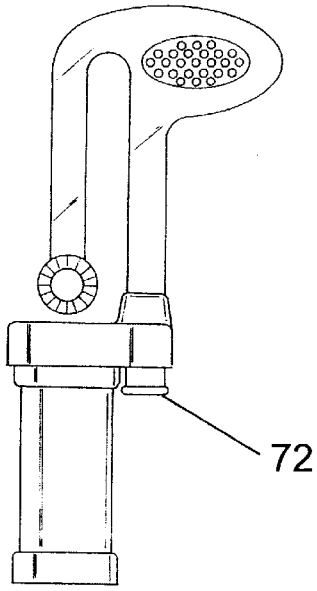
FIG. 6 illustrates a side view of the mechanism of FIG. 5 with the wand withdrawn from the container.

In this embodiment, the mechanism 64 includes a handle or grip 68 disposed at the top of the slide 66 near the transition or curved section 70 between the slide 66 and the wand 40. As best illustrated in FIG. 6, when the slide 66 is in the upward or withdrawn position, no portion of the slide 66 extends below the cap 38 except for a stop 72. The stop 72 is carried on the bottom end of the slide 66 and prevents the slide 66 from passing all the way through the guide opening 62 and being removed from the cap 38.

Figure 7:
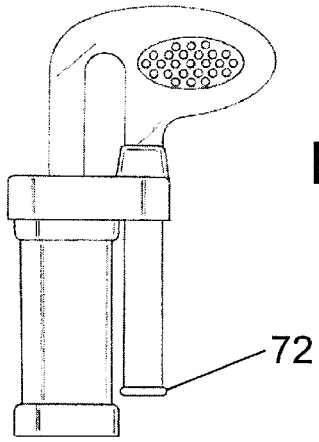
FIG. 7 illustrates a side view of the mechanism of FIG. 5 with the wand inserted into the container.
Figure 8:
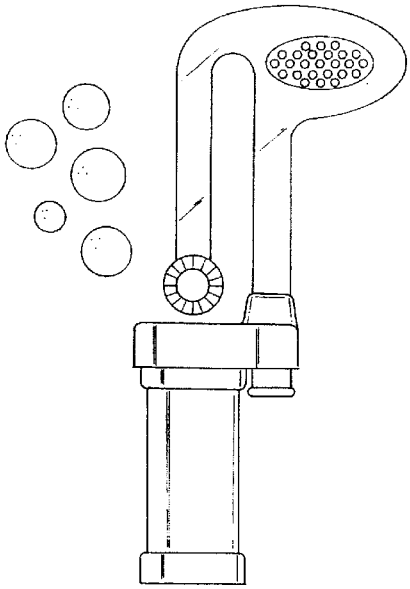
FIG. 8 illustrates a side view of the mechanism of FIG. 5 with the wand again withdrawn from the container after retrieving bubble solution and forming bubbles.

As illustrated in FIG. 7, when the slide 66 is moved to the lowered or inserted position with the wand 40 and loop 42 received in the container 32, the slide 66 does not extend below the bottom surface 36 of the container 32. In this embodiment, the container 32 can rest on a flat surface even when the slide 66 is in the lowered position In operation, the mechanism of FIG. 5 operates identical to that for the mechanism 64 of FIG. 1. A user will grip the handle 68 and manipulate the slide 66 in order to insert and withdraw the loop 42 and wand 40 relative to the bottle 32. In this embodiment, the grip 68 also includes a surface relief 74 for improving a user's grip on the slide 66.

Figure 9:
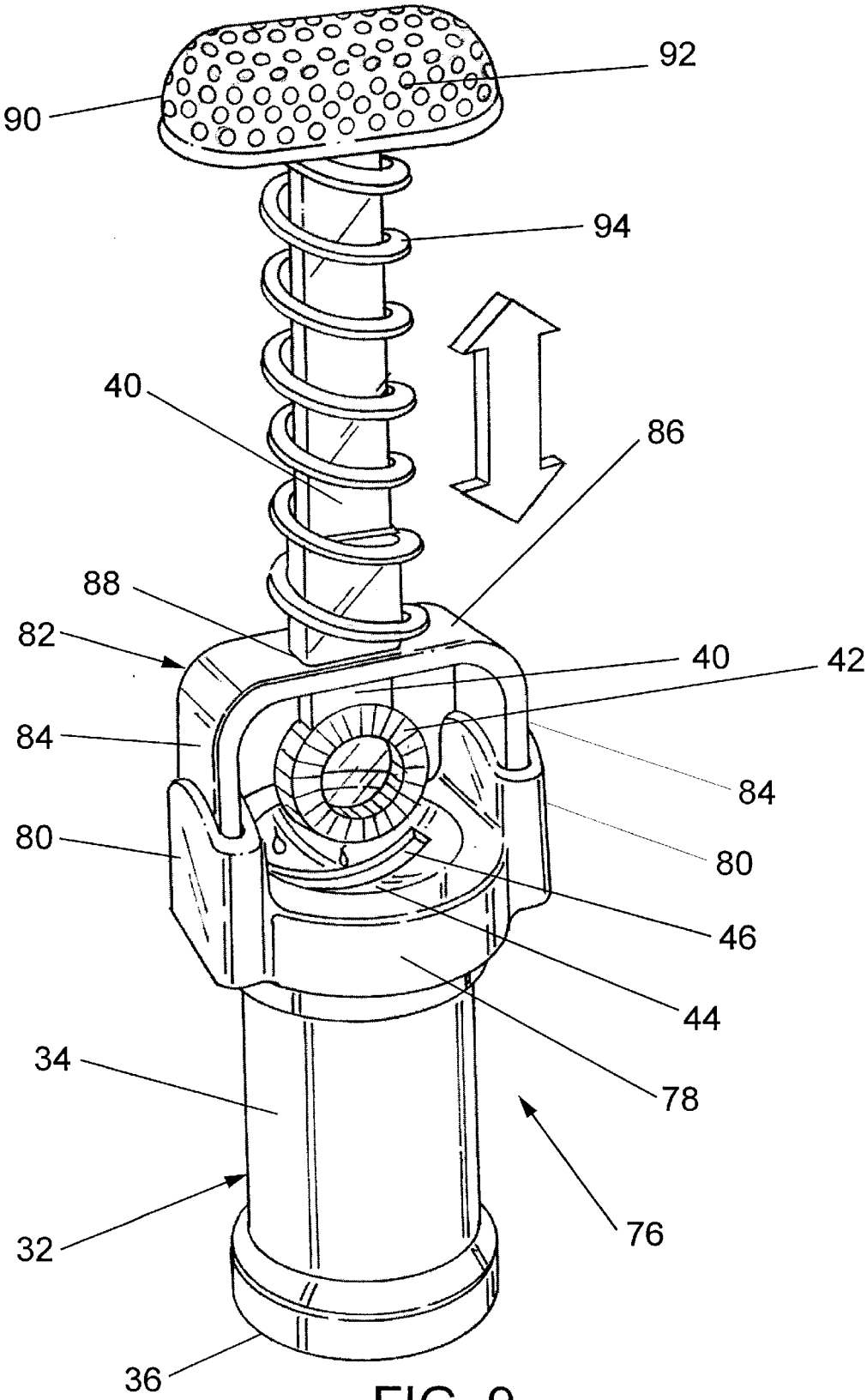
FIG. 9 illustrates a perspective view of a bubble forming mechanism constructed in accordance with another embodiment of the present invention.

Another alternative embodiment of a bubble forming mechanism 76 is illustrated in FIG. 9. In this embodiment, the container 32, wand 40 and the loop 42 are essentially identical to those disclosed in the previous embodiments. The cap or cover 78 including the concave surface 44 and slot 46 is also essentially identical. However, the guide in this embodiment is different.

The cap 78 includes a pair of integral guide supports 80 carried on opposed sides of the cap 78. A guide bracket 82 is in the form of an inverted U-shaped element having two parallel and opposed depending legs 84 interconnected at their top ends by a transverse segment 86. The two legs 84 are each received in one of the guide supports 80 so that the guide bracket 82 is held spaced above the cap 78. The guide bracket 82 also includes a slot 88 in the transverse segment 86 for receiving the wand 40 therethrough the loop 42 is carried on the bottom end of the wand 40 below the transverse segment 86 of the guide bracket 82 so that it can be inserted and withdrawn from the slot 88. The top end of the wand 40 includes a handle or grip 90 having a surface relief 92 thereon. A coil spring 94 is received over the wand 40 and is sandwiched between the handle 90 and the guide element. The spring 94 acts as a return spring 94 and abuts against the top surface of the transverse segment 86 and the bottom surface of the handle 90.

The slot 88 of the guide bracket 82 corresponds in size and shape to the size and shape of the wand 40. The slot 88 in the guide bracket 82 also orients the wand 40 in such a manner that the loop 42 aligns correctly with the slot 88 and the cap 78.

Figure 10:
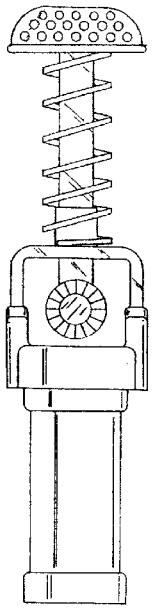
FIG. 10 illustrates a side view of the mechanism of FIG. 9 with the wand withdrawn from the container.
Figure 11:
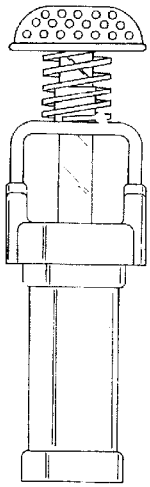
FIG. 11 illustrates a side view of the mechanism of FIG. 9 with the wand inserted into the container.
Figure 12:
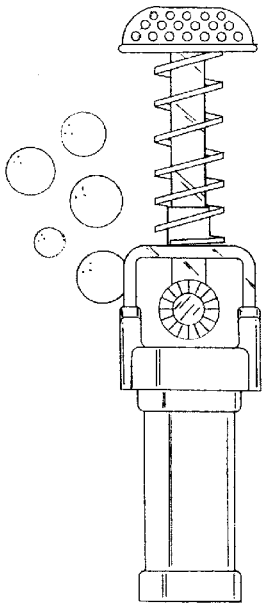
FIG. 12 illustrates a side view of the mechanism of FIG. 9 with the wand again withdrawn from the container after retrieving bubble solution and forming bubbles.

FIG. 10 illustrates the wand 40 and the loop 42 in a withdrawn position. A user simply places their hand on the handle or grip 90 and presses downward compressing the spring 94 to insert the loop 42 and wand 40 into the container 32 as illustrated in FIG. 11. The user must simply relieve pressure on the handle 90 or release it all together so that the wand 40 is forced upward by the spring 94 to the withdrawn position as illustrated in FIG. 12 after receiving a soapy solution film in the loop 42. The construction of the mechanism 76 shown in FIG. 9 including the return spring 94 permits an individual to repeatedly and very quickly and accurately insert and withdraw the wand 40 and loop 42 to form a large quantity of bubbles in a short period of time if so desired.

Figure 13:
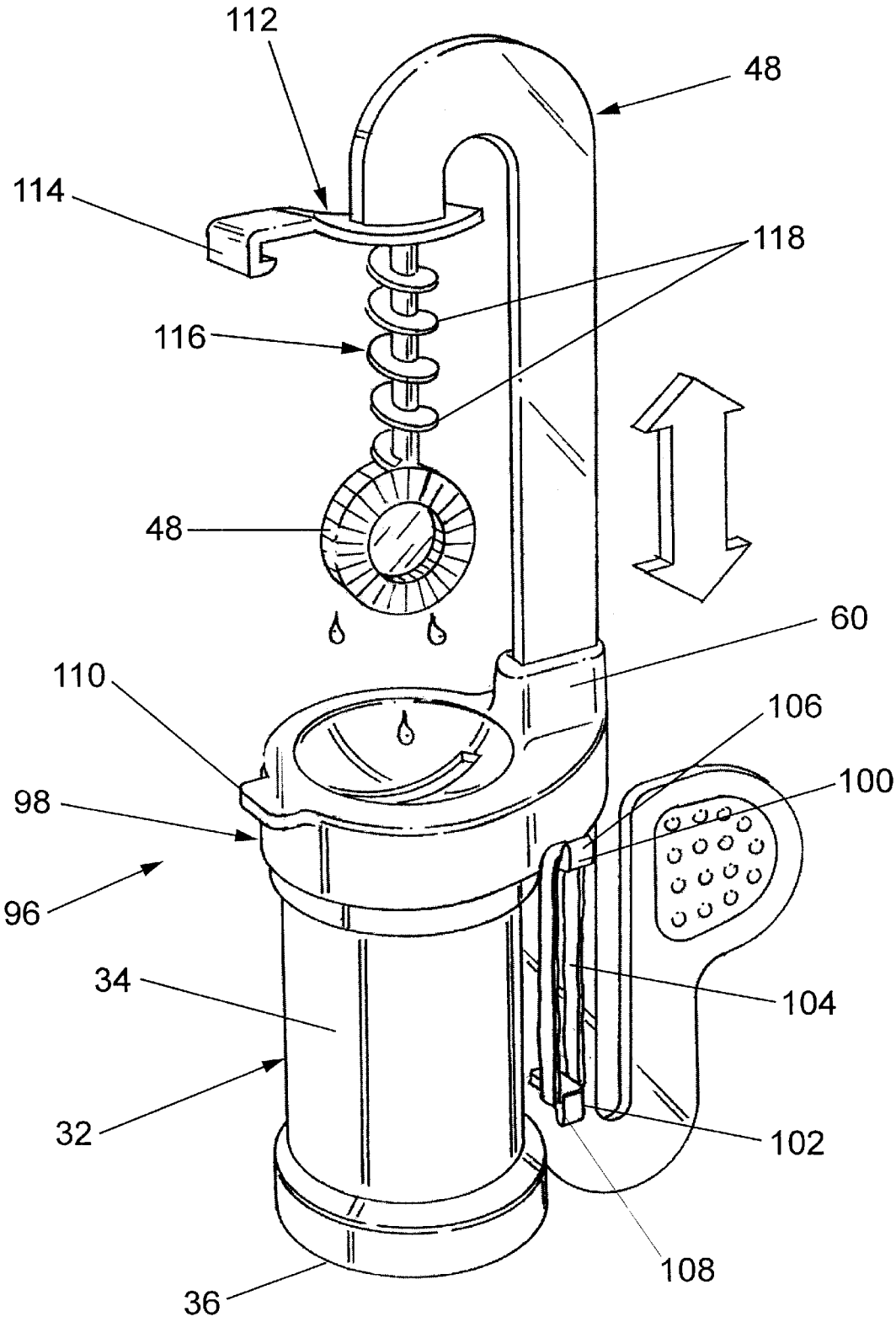
FIG. 13 illustrates a perspective view of a bubble forming mechanism constructed in accordance with another embodiment of the present invention.

FIG. 13 illustrates another alternative embodiment of a bubble forming mechanism 96. The mechanism 96 in this embodiment is similar to that described and shown in FIG. 1 but includes a number of alternative features. The container 32, cap 98, slide 48 and guide 60 are virtually identical to those disclosed for the mechanism 30 of FIG. 1. The cap 98, however, includes two small additional features that are not shown in FIG. 1.

The cap 98 has a protruding tang 100 extending therefrom near the guide 60. The lower end of the slide 48 also includes a protruding tang 102 that generally corresponds in axial location to the tang 100 of the cap 98. An elastic band 104 is received over each of the tangs 100, 102 and retained thereon by tabs 106, 108 oriented 90° relative to the respective protruding tangs and projecting away from one another. As an individual moves the slide 48 downward to insert the loop 42 and wand 40 into the container 32, the elastic band 104 stretches and stores potential energy. When a user releases the slide 48 or releases some pressure on the slide 48, the elastic band 104 will draw the slide 48 upward to the withdrawn position illustrated in FIG. 13. The elastic band 104 acts as a return element that functions to permit repeated, accurate and quick repetitions of the bubble blowing process.

Figure 14:
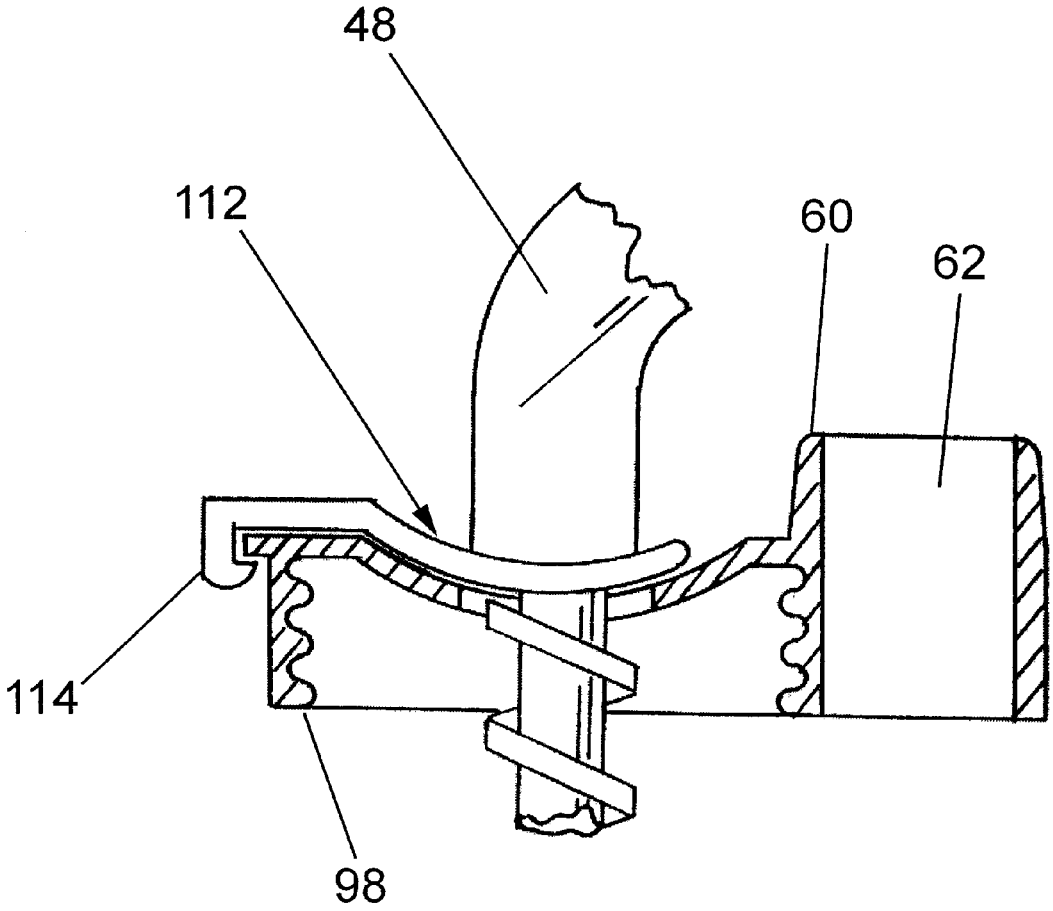
FIG. 14 illustrates a cross-section taken along lines XIV—XIV of FIG. 13.

In this embodiment, the cap 98 also includes a protruding tab 110 that extends radially relative to the axis of the container 32 and is disposed opposite the guide 60. A contoured flange 112 is provided on a portion of the wand 40 that also includes an interlocking lip 114 projecting and depending from the flange 112. The interlocking lip 114 is received over to the tab 110 on the cap 98 when the slide 48 is in the lowermost position locking the slide 48 and the wand 40 within the container 32. In this embodiment, the flange 112 is longer and wider than the slot 46 in the cap 98 and has a contour that follows the concave surface 44 of the cap 98 so that when the wand 40 is inserted in the bottle 32, the flange 112 acts as a seal for the slot 46 in the bottle 32. FIG. 14 illustrates the cross section through the cap 98 and the wand 40 in a partial fragmentary view with the wand 40 in the lowered or inserted condition and the lip 114 and tab 110 interlocked.

Also in the embodiment illustrated in FIG. 13, the substantial portion of the wand 40 between the flange 112 and the loop 42 that extends into the bottle 32 when inserted is different. In the previous embodiments, the wand 40 was of an elongate rectangular cross section having a wide surface area that helps to guide the wand 40 into the slot 46 of the cap 98 and also helps to increase the surface area of the wand 40 and collect more bubble forming solution. In this embodiment, the wand 40 includes an elongate circular cross section portion connecting the loop to the flange 112. This circular portion has a small diameter relative to the slide 48 and the remainder of the wand 40. This circular portion also includes a helical or spiral protruding structure 116 extending along the wand 40 between the loop 42 and the flange 112. This spiral structure 116 adds significantly more surface area to the wand 40 and also provides a downwardly spiraling surface 118 for additional bubble solution to drip on to the loop 42. The spiral 118 assists in forming even more bubbles than in the previously described structures.

A number of different embodiments of the invention are described above. Each of these embodiments is provided to illustrate aspects of the present invention and not to limit the present invention in any way. Modifications and changes can be made to the described embodiments and yet fall within the scope and spirit of the present invention.

What is claimed is:

1. A bubble forming mechanism comprising:

a container carrying a top surface that has a slot therein;

a guide carried by the container;

a movable wand having a loop at one end wherein at least the loop is capable of being inserted through the slot into the container; and wherein the guide guides movement of the loop into the slot.

2. The bubble forming mechanism of claim 1 wherein the top surface and the guide comprise a cap that removably attaches to the container and wherein the container is a bottle containing a soapy solution.

3. The bubble forming mechanism of claim 2 wherein the top surface has a concave portion and wherein at least part of the slot is disposed in the concave portion of the top surface to help guide soapy solution on the top surface through the slot back into the bottle.

4. The bubble forming mechanism of claim 2 wherein one of the cap and the wand comprise a tab and the other one of the cap and the wand comprise an interlocking lip that releasably engages the tab when the loop is inserted through the slot into the container retaining the loop in the container.

5. The bubble forming mechanism of claim 4 further comprising a flange disposed between the wand and the loop that seals the slot when the interlocking lip is in releasable engagement with the tab.

6. The bubble forming mechanism of claim 1 wherein the container is tubular and holds a soapy solution and the guide constrains movement of the wand and the loop in an axial direction relative to the container.

7. The bubble forming mechanism of claim 1 further comprising a slide received in the guide and which carries the wand.

8. The bubble forming mechanism of claim 7 wherein the slide and the wand are of U-shaped construction.

9. The bubble forming mechanism of claim 8 wherein a portion of the slide is disposed on one side of the guide and another portion of the slide is disposed on another side of the guide.

10. The bubble forming mechanism of claim 9 further comprising a handle carried by the slide and wherein the portion of the slide disposed on the one side of the guide carries the wand and the another portion of the guide disposed on the another side of the guide carries the handle.

11. The bubble forming mechanism of claim 10 further comprising a helical or spiral protruding structure disposed between the loop and the wand.

12. The bubble forming mechanism of claim 10 wherein the top surface and the guide comprise a cap that removably attaches to the container and wherein the container is a bottle containing a soapy solution.

13. The bubble forming mechanism of claim 12 further comprising a first tang carried by the cap and a second tang carried by the slide and an elastic band extending from the first tang to the second tang and urging the loop away from the slot.

14. The bubble forming mechanism of claim 1 wherein the wand further comprises a slide movably received in the guide wherein the slide has a stop disposed on one side of the guide and the wand is disposed on another side of the guide.

15. The bubble forming mechanism of claim 14 further comprising a handle carried by the wand.

16. The bubble forming mechanism of claim 15 wherein the wand and slide have a curved section such that the wand and slide are of U-shaped construction and the handle is carried by the curved section of the wand.

17. The bubble forming mechanism of claim 1 wherein the guide comprises a generally U-shaped guide bracket with a wand-receiving slot therein through which the wand extends.

18. The bubble forming mechanism of claim 17 wherein the wand has a handle at its free end and has a spring disposed between the guide bracket and the handle urging the loop away from the slot in the top surface of the container.

19. The bubble forming mechanism of claim 18 wherein the top surface and the guide comprise a cap that removably attaches to the container, wherein the cap comprises a pair of spaced apart guide bracket supports, and wherein the container comprises a bottle capable of holding a soapy solution.

20. A bubble forming mechanism comprising:

a bottle having a concave top surface;

a slot formed in the concave top surface;

a guide carried by a portion of the container;

a wand having a loop carried on the bottom end wherein the wand and loop are capable of being received through the slot into the container; and wherein the guide aligns the wand and loop with the slot.

21. A bubble forming mechanism comprising:

a bottle capable of holding a soapy solution and having an opening at one end;

a cap removably received on the bottle covering its opening, the cap carrying a guide and having a slot therein;

a wand having a bubble-blowing loop at one end, a slide carried by the guide, and a handle spaced from the loop; and wherein the guide positions the loop over the slot and guides movement of the loop through slot into the bottle.

22. The bubble forming mechanism of claim 21 further comprising a biasing element that urges the loop away from the slot.

23. The bubble forming mechanism of claim 22 wherein the biasing element comprises a rubber band.

24. The bubble forming mechanism of claim 22 wherein the biasing element comprises a spring.

25. The bubble forming mechanism of claim 22 further comprising a depression in the cap that urges soapy solution that drips from the loop into the slot when the loop has been removed from the slot.

26. The bubble forming mechanism of claim 21 further comprising a flange that extends outwardly from the wand to seal the slot when the loop has been inserted through the slot into the bottle.

27. The bubble forming mechanism of claim 21 further comprising a tab on the cap and an interlocking lip carried by the wand that releasably engages the tab when the loop has been inserted through the slot to releasably retain the loop in the bottle.

28. The bubble forming mechanism of claim 21 further comprising a spiral portion disposed adjacent to loop to encourage bubble formation.

* * * * *